US009635921B2

(12) United States Patent
Xiaomin

(10) Patent No.: US 9,635,921 B2
(45) Date of Patent: May 2, 2017

(54) CONSTRUCTION OF LUGGAGE AND LUGGAGE

(71) Applicant: Triforce Luggage, LLC., Miami, FL (US)

(72) Inventor: Xiao Xiaomin, Jiaxing (CN)

(73) Assignee: TRIFORCE LUGGAGE, LLC., Miami, FL (US)

( * ) Notice: Subject to any disclaimer, the term of this patent is extended or adjusted under 35 U.S.C. 154(b) by 0 days.

(21) Appl. No.: 14/711,978

(22) Filed: May 14, 2015

(65) Prior Publication Data

US 2016/0073754 A1 Mar. 17, 2016

(30) Foreign Application Priority Data

May 14, 2014 (CN) ..... 2014 2 0278719 U

(51) Int. Cl.
*A45C 5/14* (2006.01)
*A45C 13/36* (2006.01)
(Continued)

(52) U.S. Cl.
CPC ..... *A45C 13/36* (2013.01); *A45C 5/02* (2013.01); *A45C 5/14* (2013.01); *A45C 13/262* (2013.01); *A45C 5/03* (2013.01)

(58) Field of Classification Search
CPC ..... A45C 5/14; A45C 13/36
(Continued)

(56) References Cited

U.S. PATENT DOCUMENTS 1,589,029 A * 6/1926 Wheary ..... A45C 13/36 190/28
2,006,673 A * 7/1935 Crawford ..... A45F 3/00 190/37

(Continued)

FOREIGN PATENT DOCUMENTS

CN 201709610 U 1/2011
DE 19818764 A1 * 6/1999 ..... A45C 5/02

OTHER PUBLICATIONS

Espacenet English abstract of CN 201709610 U.

*Primary Examiner* — Sue A Weaver
(74) *Attorney, Agent, or Firm* — Ladas & Parry LLP

(57) ABSTRACT

The present utility model relates to a box body structure of a draw-bar box and the draw-bar box. The draw-bar box comprises a box body and a telescopic draw bar. First extrusion-molded blocks are provided at four corners of an upper end of the box body, and second extrusion-molded blocks are provided at four corners of a lower end of the box body, the first and second extrusion-molded blocks respectively being in threaded connection with the box body. The first extrusion-molded block comprises a first outer corner protector located on the outside of the box body, and a first inner corner protector located on the inside of the box body and mating with the first outer corner protector, the first outer corner protector being in threaded connection with the first inner corner protector. The second extrusion-molded block comprises a second outer corner protector located on the outside of the box body, and a second inner corner protector located on the inside of the box body and mating with the second outer corner protector, the second outer corner protector being in threaded connection with the second inner corner protector. Rollers are provided on at least two of the second extrusion-molded blocks at the lower end of the box body. The present utility model has a simple
(Continued)

structure, reasonable design and convenient use, and also has the advantages of low production costs, stronger firmness, and hardly deformed corners.

20 Claims, 6 Drawing Sheets

(51) Int. Cl.
*A45C 13/26* (2006.01)
*A45C 5/02* (2006.01)
*A45C 5/03* (2006.01)

(58) Field of Classification Search
USPC ..... 190/37, 18 A
See application file for complete search history.

(56) References Cited

U.S. PATENT DOCUMENTS 4,770,312 A * 9/1988 O ..... A45C 7/0036 190/107
5,115,895 A * 5/1992 Myers ..... A45C 5/14 190/123
8,443,509 B1 * 5/2013 De Souza ..... H02K 15/0081 29/564.2
8,783,432 B2 * 7/2014 Wang ..... A45C 5/03 190/115
2006/0032719 A1 * 2/2006 Lantz ..... A44B 19/301 190/120
2006/0207848 A1 * 9/2006 Sher ..... A45C 5/14 190/18 A
2012/0173462 A1 * 7/2012 Tropp ..... E05B 35/105 705/500
2014/0311847 A1 * 10/2014 Hillaert ..... A45C 5/14 190/18 A

* cited by examiner

CONSTRUCTION OF LUGGAGE AND LUGGAGE

TECHNICAL FIELD

The present utility model relates to a luggage, and in particular to a box body structure of a draw-bar box and the draw-bar box.

BACKGROUND ART

A draw-bar box refers to a luggage case having a draw bar and rollers. Since it is convenient to use and to carry clothes, it is widely used in travelling or outings.

An existing draw-bar box generally comprises a box body, a draw bar and rollers. The draw-bar box has eight corners formed by mould-extruding the whole box surface in the manufacture process, which causes high manufacture costs and easily deformed corners. Moreover, the eight corners of the draw-bar box can be easily damaged by collision when the draw-bar box is dragged and carried. Furthermore, the rollers arranged at the lower part of the box body of the draw-bar box generally cannot be turned, meaning that it is laborsome and inconvenient to drag the draw-bar box, especially when the draw-bar box carries many items.

Chinese patent CN 201709610 U discloses a draw-bar box, comprising a box body, a box cover and a draw bar, lower corners of the box body being provided with first corner protectors on which first universal wheels are provided. Since this utility model adopts the above-mentioned technical solution to provide the corner protectors at the lower corners of the box body, the lower corners will not be easily damaged in the case of collision when the draw-bar box is dragged and carried, and since the universal wheels are provided, the draw-bar box can be dragged without too much effort, so that the draw-bar box has a simple structure, is strong, and is convenient to use. Although this utility model solves the problems that the lower corners would be easily damaged by collision when the draw-bar box is dragged or carried and the rollers at the lower part of the box body cannot be turned, it still has defects such as high manufacture costs and easily deformed upper corners.

Contents of the Utility Model

In order to overcome the disadvantages in the prior art, the present utility model provides a draw-bar box which is simple to manufacture, and has low costs, good firmness and convenient use.

A box body structure of a draw-bar box comprises a box body, characterized in that first extrusion-moulded blocks are provided at four corners of an upper end of the box body, and second extrusion-moulded blocks are provided at four corners of a lower end of the box body, the first and second extrusion-moulded blocks respectively being in threaded connection with the box body; the first extrusion-moulded block comprises a first outer corner protector located on the outside of the box body, and a first inner corner protector located on the inside of the box body and mating with the first outer corner protector, the first outer corner protector being in threaded connection with the first inner corner protector; and the second extrusion-moulded block comprises a second outer corner protector located on the outside of the box body, and a second inner corner protector located on the inside of the box body and mating with the second outer corner protector, the second outer corner protector being in threaded connection with the second inner corner protector.

Preferably, the box body is composed of a left and a right box body closed by means of a zipper.

Preferably, several first fastening caps having internal threads are provided on an inner wall of the first outer corner protector, and several first fixing columns mating with the first fastening caps and having through-holes are correspondingly provided on an inner wall of the first inner corner protector and fixed to the first fastening caps by means of screws penetrating through the through-holes; and several second fastening caps having internal threads are provided on an inner wall of the second outer corner protector, and several second fixing columns mating with the second fastening caps and having through-holes are correspondingly provided on an inner wall of the second inner corner protector and fixed to the second fastening caps by means of screws penetrating through the through-holes. A three-dimensional structure of the box body is formed by extrusion moulding and by connection in this way, without the need of using a mould, thereby reducing the production costs.

A draw-bar box comprises a box body and a telescopic draw bar, characterized in that first extrusion-moulded blocks are provided at four corners of an upper end of the box body, and second extrusion-moulded blocks are provided at four corners of a lower end of the box body, the first and second extrusion-moulded blocks respectively being in threaded connection with the box body; the first extrusion-moulded block comprises a first outer corner protector located on the outside of the box body, and a first inner corner protector located on the inside of the box body and mating with the first outer corner protector, the first outer corner protector being in threaded connection with the first inner corner protector; the second extrusion-moulded block comprises a second outer corner protector located on the outside of the box body, and a second inner corner protector located on the inside of the box body and mating with the second outer corner protector, the second outer corner protector being in threaded connection with the second inner corner protector; and rollers are provided on at least two of the second extrusion-moulded blocks at the lower end of the box body.

Preferably, the box body is composed of a left and a right box body closed by means of a zipper.

Preferably, the box body is provided with a lock body for cooperating with the zipper, the lock body is of a TSA lock structure, and a handle is provided on the upper end of the box body. That is to say, the lock can be unlocked by using a password set by a user himself or by using a key, and is more worry-saving and convenient; and by the arrangement of the handle at the upper end, the draw-bar box can be lifted and carried on some road segments on which the draw-bar box is not convenient to drag.

Preferably, the lock body is arranged at an upper end of one side of the left box body. The lock body can be opened and closed conveniently and safely.

Preferably, several first fastening caps having internal threads are provided on an inner wall of the first outer corner protector, and several first fixing columns mating with the first fastening caps and having through-holes are correspondingly provided on an inner wall of the first inner corner protector and fixed to the first fastening caps by means of screws penetrating through the through-holes; and several second fastening caps having internal threads are provided on an inner wall of the second outer corner protector, and several second fixing columns mating with the second fastening caps and having through-holes are correspondingly provided on an inner wall of the second inner corner protector and fixed to the second fastening caps by means of screws penetrating through the through-holes.

Preferably, the first fastening caps and the first fixing columns are respectively seven in number, and the second fastening caps and the second fixing columns are respectively three in number.

Preferably, a roller is provided on each of the four second extrusion-moulded blocks at the lower end of the box body, and the roller is a universal silent wheel. By the arrangement of the universal silent wheels, the draw-bar box can be dragged without too much effort, and the universal silent wheels are strong and durable, can easily release forces without reducing the carrying capacity, so that moving on a rough road can be as easy as moving on a planar road.

The present utility model has a simple structure, reasonable design and convenient use, and also has the advantages of low production costs, stronger firmness, and hardly deformed corners.

DETAILED DESCRIPTION OF EMBODIMENTS

Figure 1:
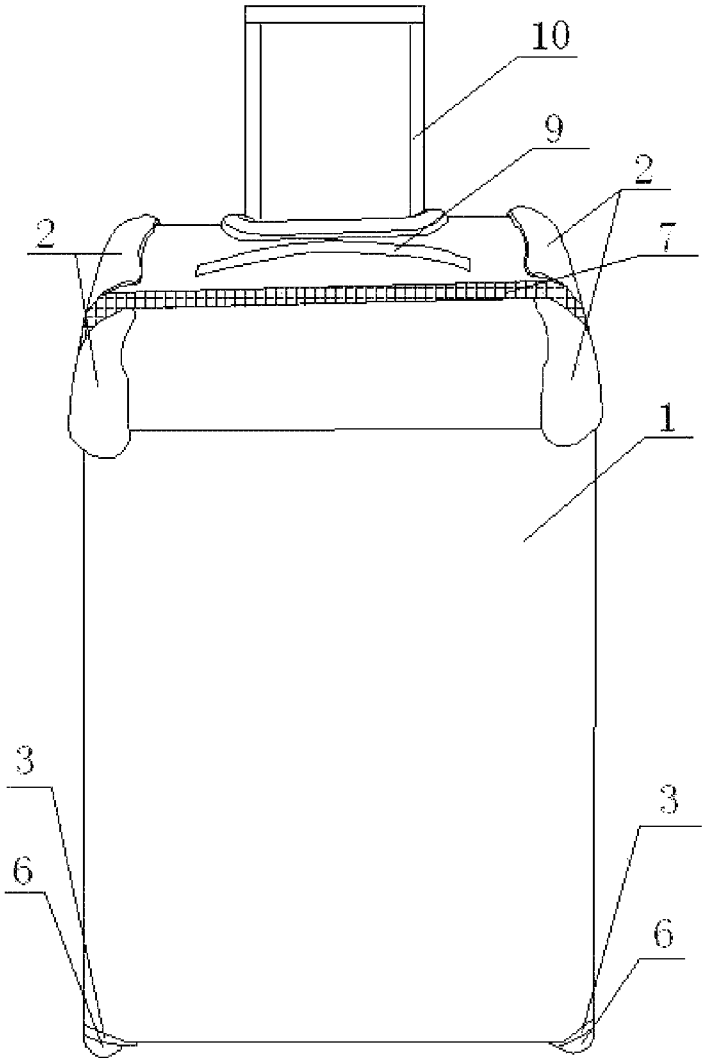
FIG. 1 is a structural schematic view of the present utility model.
Figure 2:
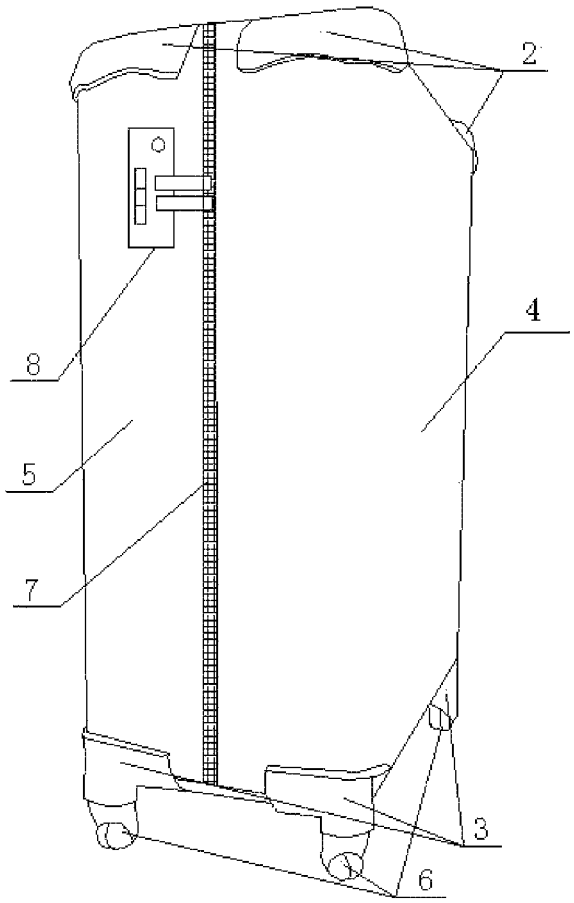
FIG. 2 is a side view of the present utility model.
Figure 3:
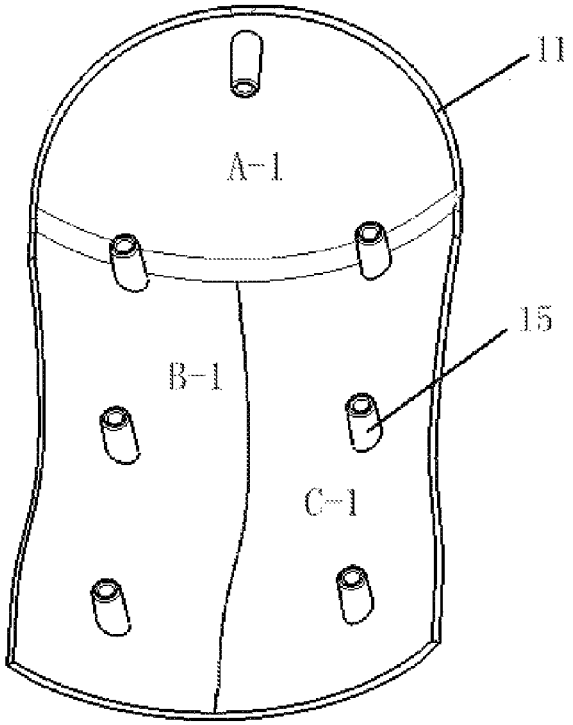
FIG. 3 is a structural schematic view of a first outer corner protector of the present utility model.
Figure 4:
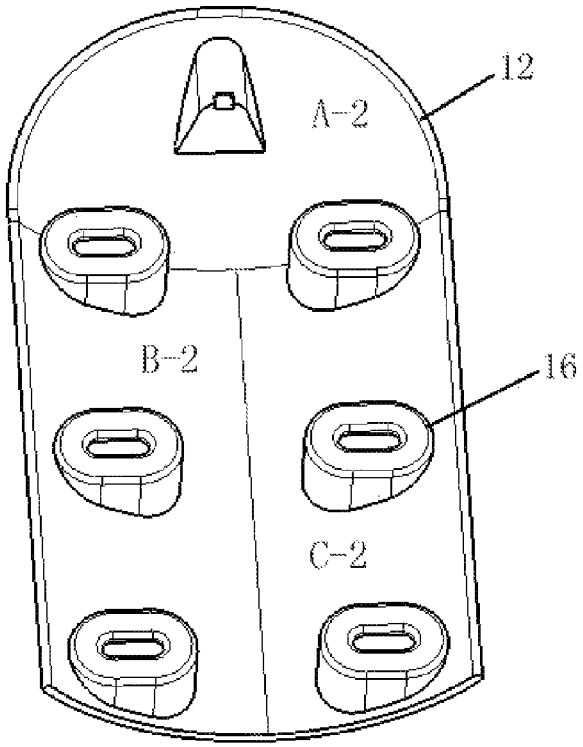
FIG. 4 is a structural schematic view of a first inner corner protector of the present utility model.
Figure 5:
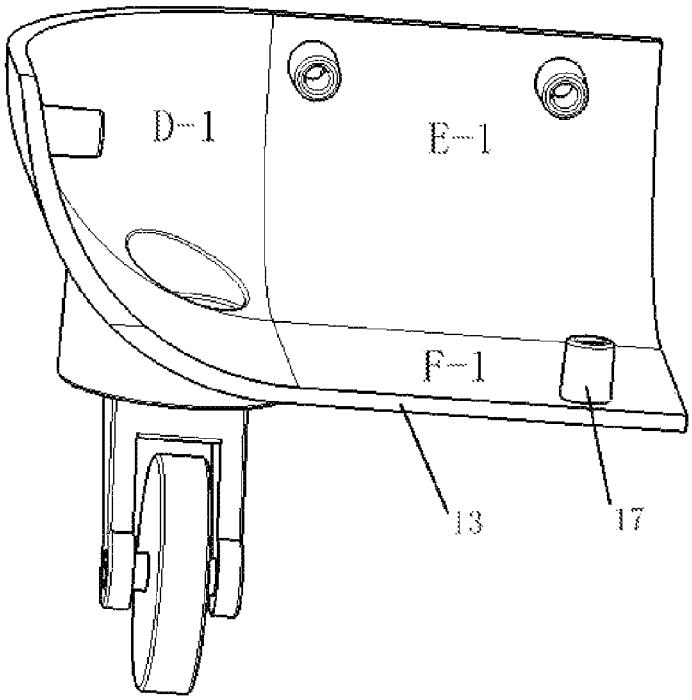
FIG. 5 is a structural schematic view of a second outer corner protector of the present utility model.
Figure 6:
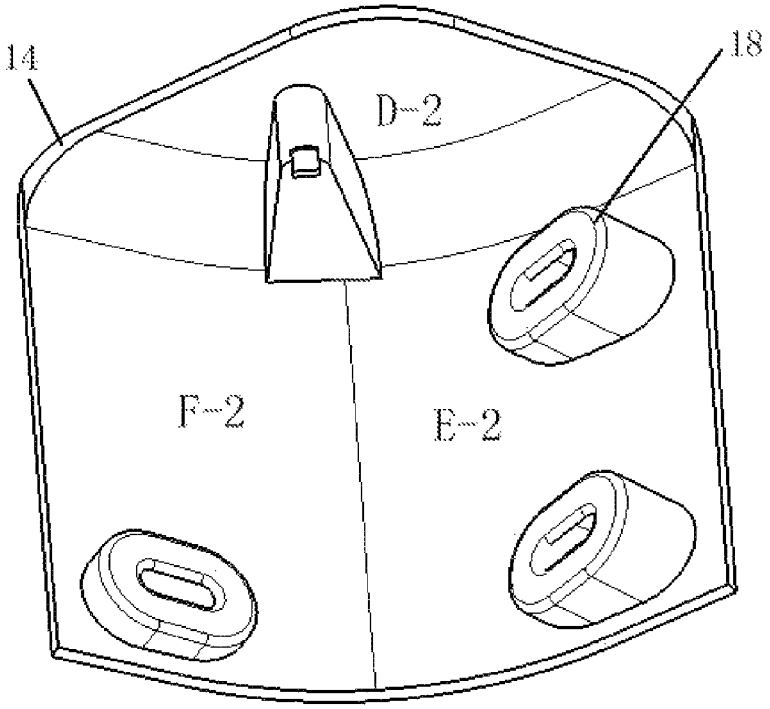
FIG. 6 is a structural schematic view of a second inner corner protector of the present utility model.

The present utility model will be further described below in conjunction with the accompanying drawings and embodiments, but the scope of protection of the present utility model is not thereby limited.

Embodiment 1

With reference to FIGS. 1-6, a box body structure of a draw-bar box comprises a box body 1, and the box body 1 is composed of a left box body 5 and a right box body 4 closed by means of a zipper 7. First extrusion-moulded blocks 2 are provided at all four corners 101 of an upper end of the box body 1, second extrusion-moulded blocks 3 are provided at all four corners 102 of a lower end of the box body 1, the first extrusion-moulded block 2 and the second extrusion-moulded block 3 are respectively in threaded connection with the box body 1, the first extrusion-moulded block 2 comprises a first outer corner protector 11 located on the outside of the box body 1, and a first inner corner protector 12 located on the inside of the box body 1 and mating with the first outer corner protector 11, and the second extrusion-moulded block 3 comprises a second outer corner protector 13 located on the outside of the box body 1 and a second inner corner protector 14 located on the inside of the box body 1 and mating with the second outer corner protector 13.

Figure 7:
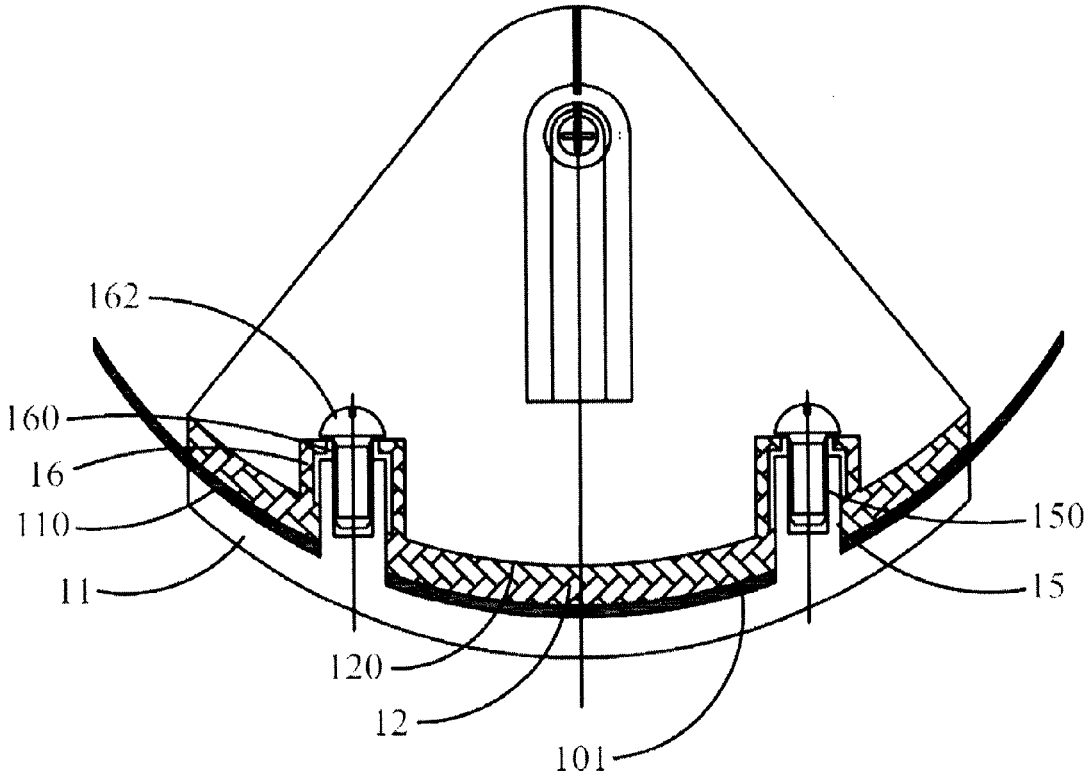
FIG. 7 is a cross-sectional view showing a first fixing column of the first inner corner protector fixed to a first fastening cap of the first outer corner protector by a screw.

Referring also to FIG. 7, seven first fastening caps 15 having internal threads 150 are provided on an inner wall 110 of the first outer corner protector 11, and seven first fixing columns 16 mating with the first fastening caps 15 and having through-holes 160 are correspondingly provided on an inner wall 120 of the first inner corner protector 12 and fixed to the first fastening caps 15 by means of screws 162 penetrating through the through-holes 160, wherein the first outer corner protector 11 is of a three-side corner protector structure; the first outer corner protector 11 is composed of curved surfaces A-1, B-1 and C-1, one first fastening cap 15 being provided on the curved surface A-1, and three first fastening caps 15 being provided at intervals on each of the curved surfaces B-1 and C-1; the first inner corner protector 12 is of a three-side corner protector structure mating with the first outer corner protector 11; and the first inner corner protector 12 is composed of curved surfaces A-2, B-2 and C-2, one first fixing column 16 mating with the first fastening cap 15 on the curved surface A-1 and having a through-hole 160 being provided on the curved surface A-2, and three first fixing columns 16 mating with the first fastening caps 15 on the curved surfaces B-1 and C-1 and having through-holes 160 being provided on each of the curved surfaces B-2 and C-2.

Figure 8:
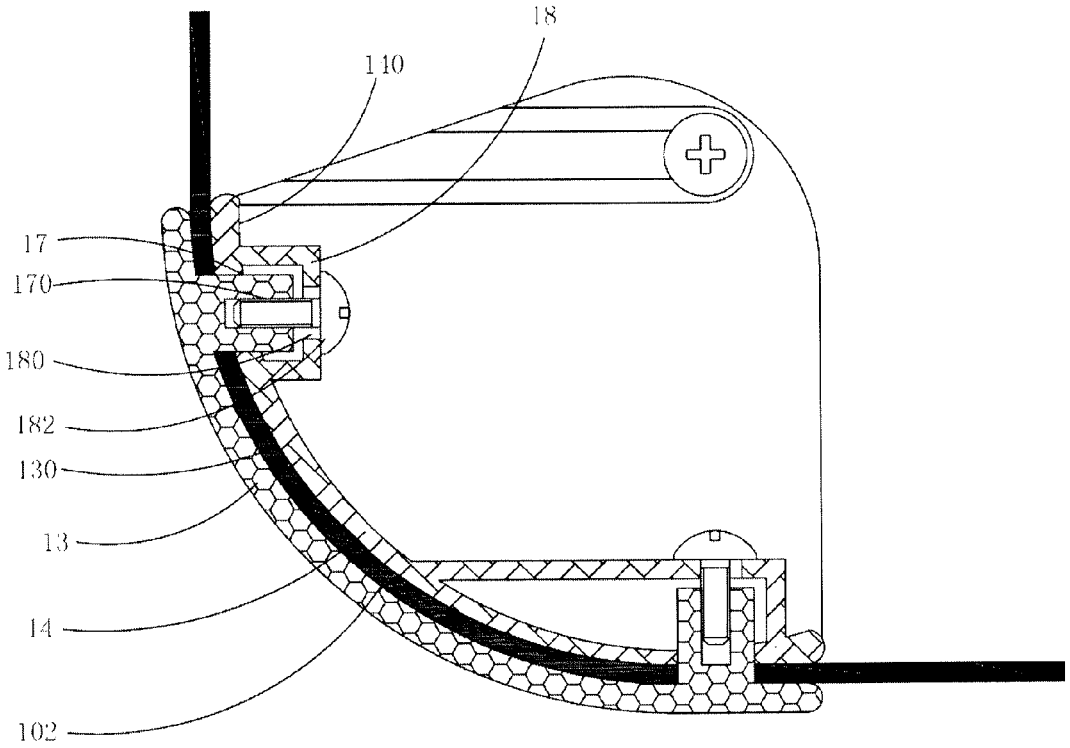
FIG. 8 is a cross-sectional view showing a second fixing column of the second inner corner protector fixed to a second fastening cap of the second outer corner protector by another screw.

Referring also to FIG. 8, three second fastening caps 17 having internal threads 170 are provided on an inner wall 130 of the second outer corner protector 13, and three second fixing columns 18 mating with the second fastening caps 17 and having through-holes 180 are correspondingly provided on an inner wall 140 of the second inner corner protector 14 and fixed to the second fastening caps 17 by means of screws 182 penetrating through the through-holes 180, wherein the second outer corner protector 13 is of a three-side corner protector structure; the second outer corner protector 13 is composed of curved surfaces D-1, E-1 and F-1, one second fastening cap 17 being provided on the curved surface D-1, two second fastening caps 17 being provided at intervals on the curved surface E-1, and one second fastening cap 17 being provided on the curved surface F-1; the second inner corner protector 14 is of a three-side corner protector structure mating with the second outer corner protector 13; and the second inner corner protector 14 is composed of curved surfaces D-2, E-2 and F-2, one second fixing column 18 mating with the second fastening cap 17 on the curved surface D-1 and having a through-hole 180 being provided on the curved surface D-2, two second fixing columns 18 mating with the second fastening caps 17 on the curved surface E-1 and having through-holes 180 being provided on the curved surface E-2, and one second fixing column 18 mating with the second fastening cap 17 on the curved surface F-1 and having a through-hole 180 being provided on the curved surface F-2.

By mating the fastening caps 15, 17 on the inner walls 110, 130 of the first and second outer corner protectors 11, 13 respectively with the corresponding fixing columns 16, 18 having through-holes 160, 180 on the first and second inner corner protectors 12, 14 and connecting and fixing the inner and outer corner protectors 11, 12, 13, 14 by means of screws 162, 182, and further extrusion moulding the three-dimensional structure of the box body by such a connection, no mould is required, thereby reducing the production costs.

Embodiment 2

With reference to FIGS. 1-6, a draw-bar box comprises a box body 1 and a telescopic draw bar 10, and the box body 1 is composed of a left box body 5 and a right box body 4 closed by means of a zipper 7. First extrusion-moulded blocks 2 are provided at all four corners 101 of an upper end of the box body 1, second extrusion-moulded blocks 3 are provided at all four corners 102 of a lower end of the box body 1, the first extrusion-moulded block 2 and the second extrusion-moulded block 3 are respectively in threaded connection with the box body 1, the first extrusion-moulded block comprises a first outer corner protector 11 located on the outside of the box body 1, and a first inner corner protector 12 located on the inside of the box body 1 and mating with the first outer corner protector 11, and the second extrusion-moulded block comprises a second outer corner protector 13 located on the outside of the box body and a second inner corner protector 14 located on the inside of the box body and mating with the second outer corner protector; rollers 6 are provided on at least two of the second extrusion-moulded blocks 3 at the lower end of the box body 1.

Referring also to FIG. 7, seven first fastening caps 15 having internal threads 150 are provided on an inner wall 110 of the first outer corner protector 11, and seven first fixing columns 16 mating with the first fastening caps 15 and having through-holes 160 are correspondingly provided on an inner wall 120 of the first inner corner protector 12 and fixed to the first fastening caps 15 by means of screws 162 penetrating through the through-holes 160, wherein the first outer corner protector 11 is of a three-side corner protector structure; the first outer corner protector 11 is composed of curved surfaces A-1, B-1 and C-1, one first fastening cap 15 being provided on the curved surface A-1, and three first fastening caps 15 being provided at intervals on each of the curved surfaces B-1 and C-1; the first inner corner protector 12 is of a three-side corner protector structure mating with the first outer corner protector 11; and the first inner corner protector 12 is composed of curved surfaces A-2, B-2 and C-2, one first fixing column 16 mating with the first fastening cap 15 on the curved surface A-1 and having a through-hole 160 being provided on the curved surface A-2, and three first fixing columns 16 mating with the first fastening caps 15 on the curved surfaces B-1 and C-1 and having through-holes 160 being provided on each of the curved surfaces B-2 and C-2.

Referring also to FIG. 8, three second fastening caps 17 having internal threads 170 are provided on an inner wall 130 of the second outer corner protector 13, and three second fixing columns 18 mating with the second fastening caps 17 and having through-holes 180 are correspondingly provided on an inner wall 140 of the second inner corner protector 14 and fixed to the second fastening caps 17 by means of screws 182 penetrating through the through-holes 180, wherein the second outer corner protector 13 is of a three-side corner protector structure; the second outer corner protector 13 is composed of curved surfaces D-1, E-1 and F-1, one second fastening cap 17 being provided on the curved surface D-1, two second fastening caps 17 being provided at intervals on the curved surface E-1, and one second fastening cap 17 being provided on the curved surface F-1; the second inner corner protector 14 is of a three-side corner protector structure mating with the second outer corner protector 13; and the second inner corner protector 14 is composed of curved surfaces D-2, E-2 and F-2, one second fixing column 18 mating with the second fastening cap 17 on the curved surface D-1 and having a through-hole 180 being provided on the curved surface D-2, two second fixing columns 18 mating with the second fastening caps 17 on the curved surface E-1 and having through-holes 180 being provided on the curved surface E-2, and one second fixing column 18 mating with the second fastening cap 17 on the curved surface F-1 and having a through-hole 180 being provided on the curved surface F-2.

By mating the fastening caps 15, 17 on the inner walls 110, 130 of the first and second outer corner protectors 11, 13 respectively with the corresponding fixing columns 16, 18 having through-holes 160, 180 on the first and second inner corner protectors 12, 14 and connecting and fixing the inner and outer corner protectors 11, 12, 13, 14 by means of screws 162, 182, and further extrusion moulding the three-dimensional structure of the box body by such a connection, no mould is required, thereby reducing the production costs.

The box body 1 is provided with a lock body 8 for cooperating with the zipper 7, the lock body 8 is of a TSA lock structure, and a handle 9 is provided on the upper end of the box body 1. That is to say, the lock can be unlocked by using a password set by a user himself or by using a key, and is more worry-saving and convenient; and by the arrangement of the handle at the upper end, the draw-bar box can be lifted and carried on some road segments on which the draw-bar box is not convenient to drag. The lock body 8 is arranged at an upper end of one side of the left box body. The lock body can be opened and closed conveniently and safely.

A roller 6 is provided on each of the four second extrusion-moulded blocks at the lower end of the box body 1, and the roller is a universal silent wheel. By the arrangement of the universal silent wheels, the draw-bar box can be dragged without too much effort; and the 360° universal silent wheels are strong and durable, are reasonably designed to increase the height thereof to a maximum degree, and can easily release forces without reducing the carrying capacity, so that moving on a rough road can be as easy as moving upon a planar road.

In the present utility model, the left box body and right box body before moulding are each a plastic plate/cloth, and when the box body is moulded, marks are made on the inner and outer corners of the plastic plate/cloth, then first outer corner protectors, first inner corner protectors, second outer corner protectors and second inner corner protectors are threadedly connected at the marks, and a three-dimensional structure of the left and right box bodies are formed by extrusion moulding. The three-dimensional structure of the box body can be formed by extrusion moulding of the first and second extrusion-moulded blocks at the corners without using a mould, thereby reducing the production costs. Moreover, since the first and second extrusion-moulded blocks of a corner protector structure are provided at the corners, the firmness is stronger and the corners would not easily deform.

The invention claimed is:

1. A box body structure of a draw-bar box, comprising:

a box body;

first extrusion-moulded blocks positioned at four corners of an upper end of the box body; and second extrusion-moulded blocks positioned at four corners of a lower end of the box body, wherein each first extrusion-moulded block comprises a first outer corner protector located on the outside of the box body, and a first inner corner protector located on the inside of the box body and mating with the first outer corner protector, the first outer corner protector is in threaded connection with the first inner corner protector, and the first outer corner protector and the first inner corner protector sandwiching a corresponding one of the four corners of the upper end of the box body therebetween; and each second extrusion-moulded block comprises a second outer corner protector located on the outside of the box body, and a second inner corner protector located on the inside of the box body and mating with the second outer corner protector, the second outer corner protector is in threaded connection with the second inner corner protector, and the second outer corner protector and the second inner corner protector sandwiching a corresponding one of the four corners of the lower end of the box body therebetween.

2. The box body structure of a draw-bar box according to claim 1, wherein the box body comprises a left box body and a right box body closed by means of a zipper.

3. The box body structure of a draw-bar box according to claim 1, wherein several first fastening caps having internal threads are positioned on an inner wall of the first outer corner protector, and several first fixing columns mating with the first fastening caps and having through-holes are correspondingly positioned on an inner wall of the first inner corner protector and fixed to the first fastening caps by means of screws penetrating through the through-holes; and several second fastening caps having internal threads are positioned on an inner wall of the second outer corner protector, and several second fixing columns mating with the second fastening caps and having through-holes are correspondingly positioned on an inner wall of the second inner corner protector and fixed to the second fastening caps by means of screws penetrating through the through-holes.

4. The box body structure of a draw-bar box according to claim 3, wherein the first outer corner protector comprises a first three-side corner protector structure which comprises a first curved surface, a second curved surface, and a third curved surface, the first, second and third curved surfaces are directly connected to each other to constitute the first three-side corner protector; the first inner corner protector comprises a second three-side corner protector structure which comprises a fourth curved surface, a fifth curved surface, and a sixth curved surface, the fourth, fifth and sixth curved surfaces are directly connected to each other to constitute the second three-side corner protector.

5. The box body structure of a draw-bar box according to claim 4, wherein one of the first fastening caps is positioned on the first curved surface, and three of the first fastening caps are positioned on each of the second and third curved surfaces; one of the first fixing columns is positioned on the fourth curved surface, and three of the first fixing columns are positioned on each of the fifth and sixth curved surfaces.

6. The box body structure of a draw-bar box according to claim 5, wherein the three first fastening caps on the second curved surface are arranged at intervals in a first straight line, the three first fastening caps on the third curved surface are arranged at intervals in a second straight line, and the first fastening cap on the first curved surface is located between the first and second straight lines; the three first fixing columns on the fifth curved surface are arranged at intervals in a third straight line, the three first fixing columns on the sixth curved surface are arranged at intervals in a fourth straight line, and the first fixing column on the fourth curved surface is located between the third and fourth straight lines.

7. The box body structure of a draw-bar box according to claim 4, wherein the second outer corner protector comprises a third three-side corner protector structure which comprises a seventh curved surface, an eighth curved surface, and a ninth curved surface, the seventh, eighth and ninth curved surfaces are directly connected to each other to constitute the third three-side corner protector; the second inner corner protector comprises a fourth three-side corner protector structure which comprises a tenth curved surface, an eleventh curved surface, and a twelfth curved surface, the tenth, eleventh and twelfth curved surfaces are directly connected to each other to constitute the fourth three-side corner protector.

8. The box body structure of a draw-bar box according to claim 7, wherein one of the second fastening caps is positioned on the seventh curved surface, two of the second fastening caps are positioned on the eighth curved surfaces, and one of the second fastening caps is positioned on the ninth curved surface; one of the second fixing columns is positioned on the tenth curved surface, two of the second fixing columns are positioned on the eleventh curved surface, and one of the second fixing columns is positioned on the twelfth curved surface.

9. A draw-bar box, comprising:

a box body;

a telescopic draw bar positioned on the box body;

first extrusion-moulded blocks positioned at four corners of an upper end of the box body;

second extrusion-moulded blocks positioned at four corners of a lower end of the box body, the first and second extrusion-moulded blocks respectively being in threaded connection with the box body; and rollers;

wherein the first extrusion-moulded block comprises a first outer corner protector located on the outside of the box body, and a first inner corner protector located on the inside of the box body and mating with the first outer corner protector, the first outer corner protector is in threaded connection with the first inner corner protector, and the first outer corner protector and the first inner corner protector sandwiching a corresponding one of the four corners of the upper end of the box body therebetween; the second extrusion-moulded block comprises a second outer corner protector located on the outside of the box body, and a second inner corner protector located on the inside of the box body and mating with the second outer corner protector, the second outer corner protector is in threaded connection with the second inner corner protector, and the second outer corner protector and the second inner corner protector sandwiching a corresponding one of the four corners of the lower end of the box body therebetween; and the rollers are positioned on at least two of the second extrusion-moulded blocks at the lower end of the box body.

10. The draw-bar box according to claim 9, wherein the box body comprises a left box body and a right box body closed by means of a zipper.

11. The draw-bar box according to claim 10, wherein the box body is provided with a lock body for cooperating with the zipper, the lock body is of a TSA lock structure, and a handle is provided on the upper end of the box body.

12. The draw-bar box according to claim 11, wherein the lock body is arranged at an upper end of one side of the left box body.

13. The draw-bar box according to claim 9, wherein several first fastening caps having internal threads are positioned on an inner wall of the first outer corner protector, and several first fixing columns mating with the first fastening caps and having through-holes are correspondingly positioned on an inner wall of the first inner corner protector and fixed to the first fastening caps by means of screws penetrating through the through-holes; and several second fastening caps having internal threads are positioned on an inner wall of the second outer corner protector, and several second fixing columns mating with the second fastening caps and having through-holes are correspondingly positioned on an inner wall of the second inner corner protector and fixed to the second fastening caps by means of screws penetrating through the through-holes.

14. The draw-bar box according to claim 13, wherein the first outer corner protector comprises a first three-side corner protector structure which comprises a first curved surface, a second curved surface, and a third curved surface, the first, second and third curved surfaces are directly connected to each other to constitute the first three-side corner protector; the first inner corner protector comprises a second three-side corner protector structure which comprises a fourth curved surface, a fifth curved surface, and a sixth curved surface, the fourth, fifth and sixth curved surfaces are directly connected to each other to constitute the second three-side corner protector.

15. The draw-bar box according to claim 14, wherein one of the first fastening caps is positioned on the first curved surface, and three of the first fastening caps are positioned on each of the second and third curved surfaces; one of the first fixing columns is positioned on the fourth curved surface, and three of the first fixing columns are positioned on each of the fifth and sixth curved surfaces.

16. The draw-bar box according to claim 15, wherein the three first fastening caps on the second curved surface are arranged at intervals in a first straight line, the three first fastening caps on the third curved surface are arranged at intervals in a second straight line, and the first fastening cap on the first curved surface is located between the first and second straight lines; the three first fixing columns on the fifth curved surface are arranged at intervals in a third straight line, the three first fixing columns on the sixth curved surface are arranged at intervals in a fourth straight line, and the first fixing column on the fourth curved surface is located between the third and fourth straight lines.

17. The draw-bar box according to claim 14, wherein the second outer corner protector comprises a third three-side corner protector structure which comprises a seventh curved surface, an eighth curved surface, and a ninth curved surface, the seventh, eighth and ninth curved surfaces are directly connected to each other to constitute the third three-side corner protector; the second inner corner protector comprises a fourth three-side corner protector structure which comprises a tenth curved surface, an eleventh curved surface, and a twelfth curved surface, the tenth, eleventh and twelfth curved surfaces are directly connected to each other to constitute the fourth three-side corner protector.

18. The draw-bar box according to claim 17, wherein one of the second fastening caps is positioned on the seventh curved surface, two of the second fastening caps are positioned on the eighth curved surfaces, and one of the second fastening caps is positioned on the ninth curved surface; one of the second fixing columns is positioned on the tenth curved surface, two of the second fixing columns are positioned on the eleventh curved surface, and one of the second fixing columns is positioned on the twelfth curved surface.

19. A box body structure of a draw-bar box, comprising:

a box body;

first extrusion-moulded blocks individually positioned at four corners of an upper end of the box body, each first extrusion-moulded block comprising a first outer corner protector and a first inner corner protector, the first outer corner protector located on the outside of the box body, the first inner corner protector located on the inside of the box body and mating with the first outer corner protector, and the first outer corner protector and the first inner corner protector sandwiching a corresponding one of the four corners of the upper end of the box body therebetween; and second extrusion-moulded blocks individually positioned at four corners of a lower end of the box body, each second extrusion-moulded block comprises a second outer corner protector and a second inner corner protector, the second outer corner protector located on the outside of the box body, the second inner corner protector located on the inside of the box body and mating with the second outer corner protector, and the second outer corner protector and the second inner corner protector sandwiching a corresponding one of the four corners of the lower end of the box body therebetween;

wherein the first outer corner protector comprises a first three-side corner protector structure which comprises a first curved surface, a second curved surface, and a third curved surface, the first, second and third curved surfaces are directly connected to each other to constitute the first three-side corner protector; the first inner corner protector comprises a second three-side corner protector structure which comprises a fourth curved surface, a fifth curved surface, and a sixth curved surface, the fourth, fifth and sixth curved surfaces are directly connected to each other to constitute the second three-side corner protector.

20. The box body structure of a draw-bar box according to claim 19, wherein one of the first fastening caps is positioned on the first curved surface, three of the first fastening caps are positioned on each of the second and third curved surfaces, the three first fastening caps on the second curved surface are arranged at intervals in a first straight line, the three first fastening caps on the third curved surface are arranged at intervals in a second straight line, and the first fastening cap on the first curved surface is located between the first and second straight lines; one of the first fixing columns is positioned on the fourth curved surface, three of the first fixing columns are positioned on each of the fifth and sixth curved surfaces, the three first fixing columns on the fifth curved surface are arranged at intervals in a third straight line, the three first fixing columns on the sixth curved surface are arranged at intervals in a fourth straight line, and the first fixing column on the fourth curved surface is located between the third and fourth straight lines.

* * * * *